US005908340A

United States Patent [19]

Voight et al.

[11] Patent Number: 5,908,340

[45] Date of Patent: Jun. 1, 1999

[54] METHOD FOR FABRICATING AN ARRAY OF CONICAL ELECTRON EMITTERS

[75] Inventors: Steven A. Voight, Gilbert; Anthony Polito, Mesa; Jeffrey Baker; Laura Siragusa, both of Chandler, all of Ariz.

[73] Assignee: Motorola, Inc., Schaumburg, Ill.

[21] Appl. No.: 08/794,557

[22] Filed: Feb. 3, 1997

[51] Int. Cl.[6] ..... H01J 9/02

[52] U.S. Cl. ..... 445/24; 204/192.1

[58] Field of Search ..... 445/24; 204/298.29, 204/192.1

[56] References Cited

U.S. PATENT DOCUMENTS 5,182,256 1/1993 Itozaki et al. ..... 204/298.29 X
5,344,352 9/1994 Horne et al. .

OTHER PUBLICATIONS van Veen et al., "Collimated Sputter Deposition, a Novel Method for Large Area Deposition of Spindt Type Field Emission Tips", *Journal of Vacuum Science & Technology B,* vol. 13, No. 2, Mar./Apr. 1995, pp. 478–481.

*Primary Examiner*—Kenneth J. Ramsey
*Attorney, Agent, or Firm*—S. Kevin Pickens; Kate Tobin

[57] ABSTRACT

A method for fabricating an array of conical electron emitters (410) includes the steps of: (i) positioning a collimator (160), including a plurality of collimation cells (162) having hexagonal cross-sections, between a substrate (155) having emitter wells (130) and a target (170) made from the emitter material, (ii) sputtering the target (170) so that it is partially collimated by the collimator (160), (iii) moving the substrate (155) within a plane defined by the substrate (155) so that the emitter wells (130) follow an emitter well path (220) which forms a 15° path angle (235) with respect to a reference line (240) of the collimator (160).

6 Claims, 4 Drawing Sheets

METHOD FOR FABRICATING AN ARRAY OF CONICAL ELECTRON EMITTERS

FIELD OF THE INVENTION

The present invention pertains to the area of field emission devices and, more particularly, to a method for fabricating cone-shaped electron emitters.

BACKGROUND OF THE INVENTION

Field emission devices are known in the art. Methods for fabricating cone-shaped electron emitters, including Spindt-tip emitters, are also known in the art.

In one prior art scheme for fabricating cone-shaped electron emitters, a combination of a substantially normal vapor deposition process and a low angle vapor deposition process are employed. It is known in the art to form an array of field emitters by forming a plurality of vias (emitter wells) in a dielectric layer and then depositing the emitter material so that one emitter cone is formed in each via. Each emitter well opening typically has a diameter in the micron range. The low angle vapor deposition provides material which continually reduces the size of the opening of the via, thereby continually reducing the diameter of the deposited material within the via. The material forming the cone is provided by the substantially normal vapor deposition process.

Another prior art scheme for forming cone-shaped field emitters includes evaporative deposition, such as by boiling or electron-beam evaporation of a field emissive material, such as molybdenum. Evaporation of tips is typically performed in a high vacuum, at pressures less than or equal to about $1\times10^{-7}$ Torr. This process is inherently collimated because the molecules depart generally radially from the source and because, subsequent their departure, they are generally not deflected by other molecules. However, the spray of molecules comprises a cone wherein the species nearer the circumference are deposited at an angle. In this manner, the deposition over the substrate varies from a substantially normal deposition at the center of the spray cone, to an angled deposition at the circumference of the spray cone. The angularity of the deposition may be tolerated to about an 8° half angle of the apex of the spray cone. For half angles greater than 8°, the cones formed at the outer portions of the deposition substrate are no longer sufficiently centered within the vias. To achieve the necessary control and uniformity of emission over the substrate, the cones must all be substantially centered within the vias.

Another disadvantage of this prior art evaporation process is that, as substrate size increases, the distance between the target and substrate must be increased to maintain the same maximum deposition angle. The increased separation between substrate and source requires an increase in volume of the deposition tool. This translates to greater maintenance requirements and a more involved evacuation process. For substrates having diameters greater than about 16 cm, the distance between substrate and evaporation source must be greater than about 60 cm. In general, this distance scales linearly with respect to substrate size.

Also known in the art is the use of a collimator which has a collimation cell diameter on the order of the dimension of a pixel, which is about a couple hundred micrometers. In this prior art scheme, the collimator is static and physically rests on the substrate surface. This configuration is completely inadequate for production scale operations because it requires tedious alignment. It also results in a variation of tip shapes and sizes over each pixel area.

Accordingly, there exists a need for an improved method for fabricating an array of conical electron emitters which is low-cost, simple to perform, efficient, and provides uniform geometry of conical emitters in large-area substrates.

BRIEF DESCRIPTION OF THE DRAWINGS

Referring to the drawings.

DESCRIPTION OF THE PREFERRED EMBODIMENTS

A method for fabricating an array of conical electron emitters, in accordance with the present invention, includes steps for realizing conical electron emitters which are centered within the emitter wells of a substrate. The present method achieves the important advantage of utilizing a sputtering deposition process which provides the benefit of a higher quality grain structure that has fewer voids, and is denser, than the grain structure of emitters realized by prior art evaporative depositions. Another important benefit of the present method is the realization of an efficient process which provides high yield and uniformly centered conical emitters. Moreover, the present method may be employed to process a wide range of substrate sizes, requiring little or no increase in the size of the equipment used to perform the steps of the present method.

Figure 1:
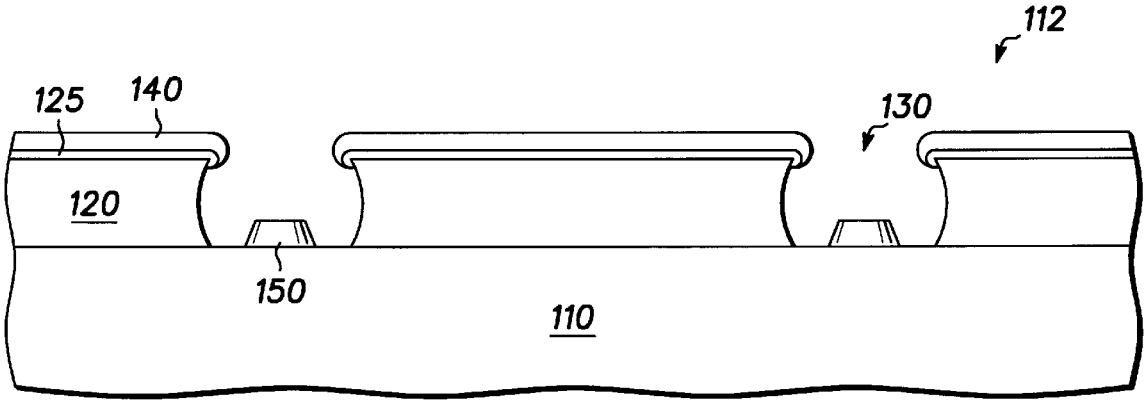
FIG. 1 is a cross-sectional view of a structure realized by performing various steps of a method for fabricating an array of conical electron emitters, in accordance with the present invention.

Referring now to FIG. 1, there is depicted a cross-sectional view of a structure 100 realized by performing various steps of a method for fabricating an array of conical electron emitters, in accordance with the present invention. Structure 100 includes a supporting substrate 110, which is a generally plate-shaped, dielectric substrate formed of glass or any other rugged dielectric material. Structure 100 includes a major surface 112 including a dielectric layer 120, which is formed on supporting substrate 110. Dielectric layer 120 is made from a dielectric material such as silicon dioxide which is deposited by some convenient method, such as plasma enhanced chemical vapor deposition (PECVD), evaporating, sputtering, or the like. Dielectric layer 120 has a thickness of within a range of about 0.8–1 $\mu$m. A plurality of emitter wells 130 are formed in dielectric layer 120 by some convenient method, such as a patterned etch process. A parting layer 125 is formed on dielectric layer 120. Thereafter, a conical emitter is formed in each of emitter wells 130 using a method for fabricating an array of conical electron emitters, in accordance with the present invention and as will be described in greater detail with reference to FIGS. 2–6.

The shape of each conical emitter is effected by several factors. One of these factors is the rate at which the opening of each of emitter wells 130 is closed off by a layer 140 of emitter material which collects upon dielectric layer 120. If this rate is too high, the emitter structure may not realize a conical shape; in the extreme case, only a small knob of material is deposited into each of emitter wells 130. This high rate condition exists if the material is deposited by sputtering without any additional collimation of the sputtered material.

Another factor which affects the shape of the conical emitters is the deposition angle of the material being received at emitter wells 130. If the emissive material is deposited at an angle to normal, a tilted cone may be formed. This tilted cone includes an emission tip which is not centered within the emitter well 130. As will be described in greater detail with reference to FIGS. 2 and 3, a collimator provides material deposition within a range of deposition angles. If the emitter well 130 receives only material within a portion of that range of deposition angles, a tilted emitter may result which also has an off-centered tip.

A plurality of partial emitter structures 150 are depicted in FIG. 1. Each of partial emitter structures 150 is symmetrical, and centered, within emitter well 130. By performing various steps of the present method, each conical electron emitter is made symmetrical with respect to the axis of emitter well 130. This symmetry is realized by repeatedly exposing of each of emitter wells 130 to substantially the full range of deposition angles, in accordance with the present invention. The present method is characterized by the step of providing cyclical lateral relative displacement between the substrate and the collimator to define a plurality of emitter well paths with respect to the collimator so that each of the plurality of emitter well paths provides substantially equal exposure of each emitter well to each of the deposition angles of the range of deposition angles, as is described in greater detail with reference to FIG. 3.

Uniformity of the size of the conical electron emitters over the array, depends, in part, upon the deposition of an equal amount of emissive material into each of emitter wells 130. According to the present method, collimation of sputtered emissive material is performed so that the collimator does not shadow the deposition, as will be described in greater detail with reference to FIG. 4.

Figure 2:
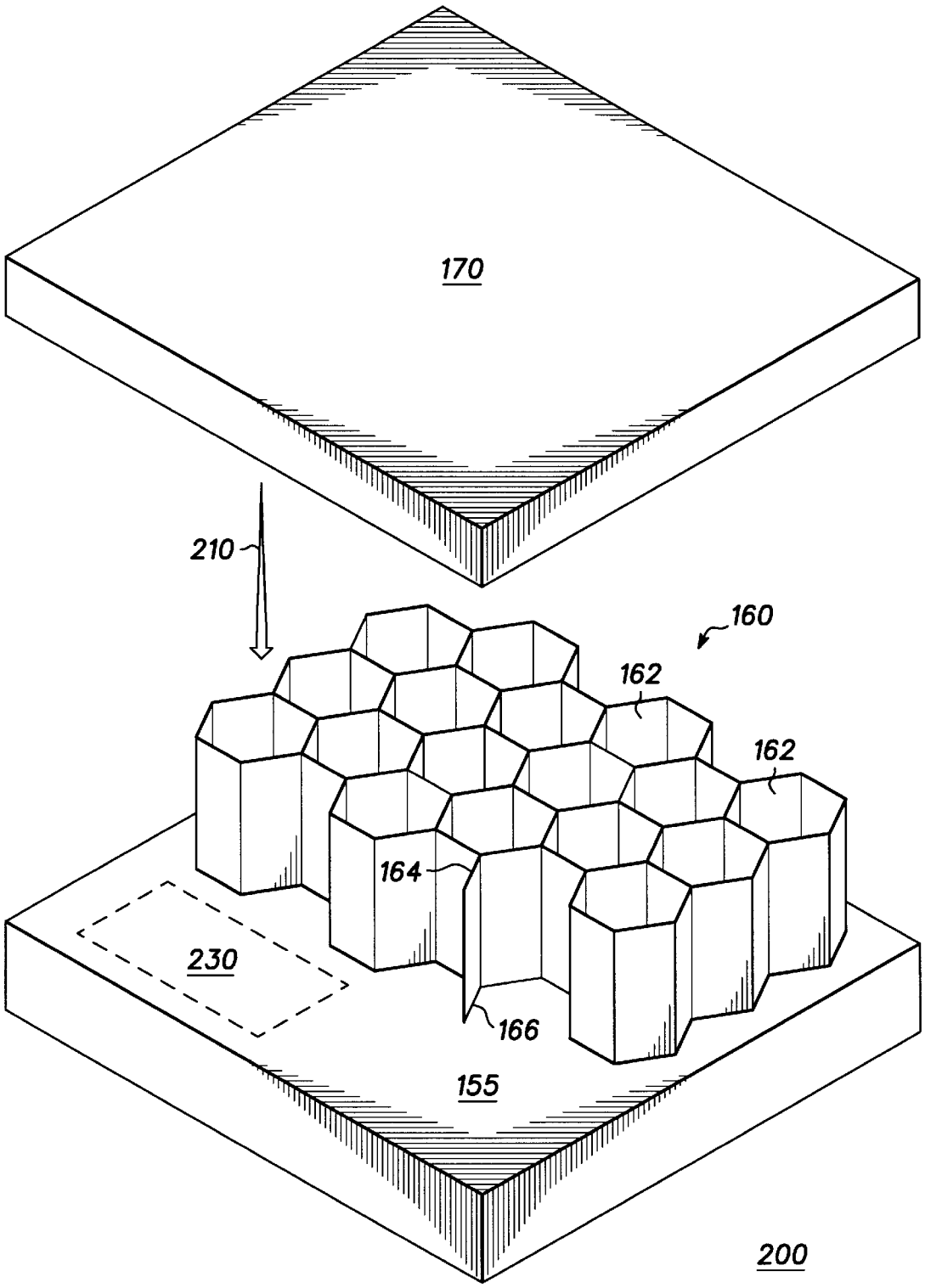
FIG. 2 is a perspective view of a deposition configuration including a collimator suitable for use in a method for fabricating an array of conical electron emitters, in accordance with the present invention.

Referring now to FIG. 2, there is depicted a perspective view of a deposition configuration 200 including a collimator 160 suitable for use in a method for fabricating an array of conical electron emitters, in accordance with the present invention. Deposition configuration 200 includes a substrate 155 having supporting substrate 110, dielectric layer 120, and an array of emitter wells 130, in a configuration similar to that of structure 100 (FIG. 1). Deposition configuration 200 further includes collimator 160, and a target 170.

Collimator 160 has a plurality of side walls 165 which define a plurality of collimation cells 162, each of which has a hexagonal cross-section. Other convenient cross-sections include circular and square shapes. Each of collimation cells 162 has an entrance aperture 164 and an exit aperture 166. Collimator 160 has a predetermined thickness, and collimation cells 162 have a predetermined cross-sectional dimension, which, in this particular embodiment, includes the distance between opposing apices of a hexagonal cross-section. The ratio of the thickness of collimator 160 to the cross9 sectional dimension (the aspect ratio) of collimation cells 162 is predetermined and is preferably within a range of 3:1 1.5:1, most preferably about 2:1. A ratio greater than about 2:1 would provide greater collimation. An important disadvantage of a ratio which is too high, is the resulting reduction in efficiency of the deposition, thereby increasing deposition time and reducing yield. An important disadvantage of a ratio which is too low is insufficient collimation, which has an adverse effect on the geometry of the electron emitters, such as an unacceptably large tip radius and closing off of the emitter well before complete formation of the conical electron emitter.

Target 170 is made from the emissive material from which the conical electron emitters are to be formed. In this particular embodiment, target 170 includes a solid piece of molybdenum. Target 170 opposes collimator 160.

Substrate 155 is positioned on the side of collimator 160 opposite target 170. The distance between substrate 155 and collimator 160 is predetermined to reduce collisions between the gaseous emitter material—subsequent exiting from exit apertures 166—and the sputtering gas. This distance depends on variables such as the system pressure.

In the operation of deposition configuration 200, target 170 is sputtered to provide a sputtered target material 210, as indicated by an arrow in FIG. 2. Sputtered target material 210 includes an uncollimated gaseous source of emitter material for forming the conical electron emitters. Sputtered target material 210 is directed toward entrance apertures 164 of collimation cells 162. Upon traveling through collimation cells 162, sputtered target material 210 becomes partially collimated. A partially collimated beam exits at each of exit apertures 166 and then is received by substrate 155, in the manner described with reference to FIG. 1.

Other means for providing an uncollimated gaseous source of emitter material will occur to one skilled in the art and may be employed to perform various steps of the present method.

Figure 3:
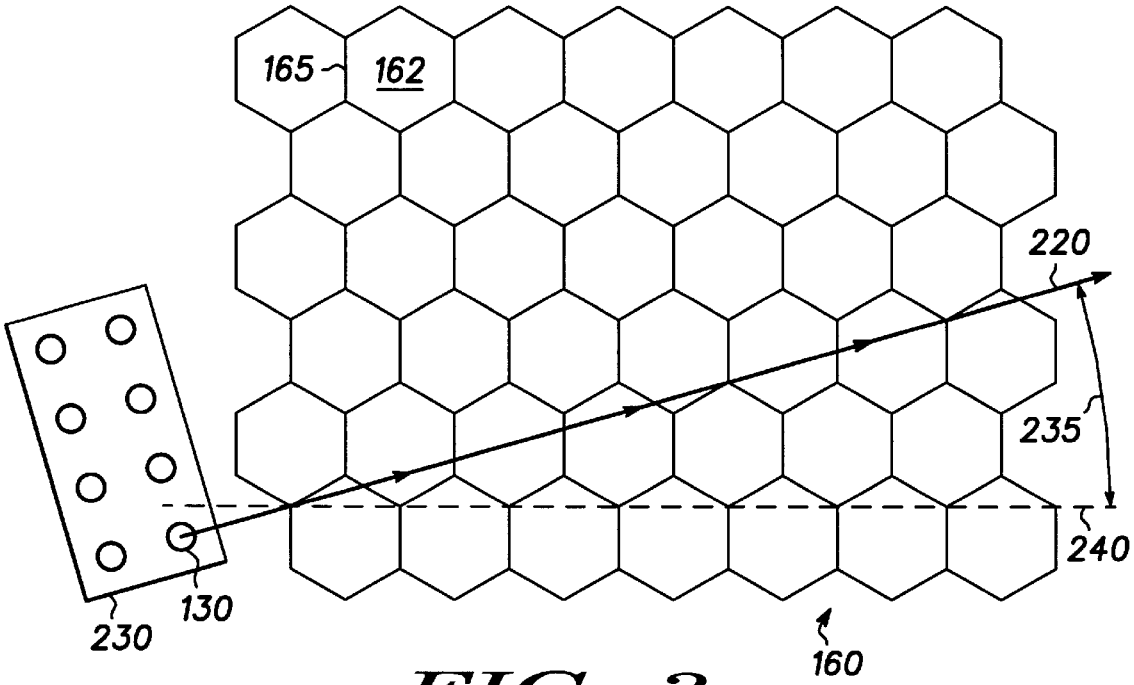
FIG. 3 is a top plan view of the collimator of FIG. 2 and further indicates a path of an emitter well with respect to the collimator, in accordance with the present invention.

Referring now to FIG. 3, there is depicted a top plan view of collimator 160 and further indicates an emitter well path 220 of emitter well 130 with respect to collimator 160, in accordance with the present invention. A portion 230 (FIG. 2) of substrate 155 is also depicted, the size of emitter wells 130 being exaggerated for ease of understanding. A portion of sputtered target material 210 (FIG. 2) exits from exit apertures 166, to provide a partially collimated beam. This material exits within a range of deposition angles, which are defined with respect to the axis of collimation cells 162. The range of deposition angles is determined by the aspect ratio of the collimator. Emitter well path 220 is realized by moving emitter well 130 relative to collimator 160 so that emitter well 130 receives substantially equal exposure to material having deposition angles within the full range of the range of deposition angles. In accordance with the present invention, emitter well 130 is moved repeatedly along emitter well path 220 to provide multiple exposures to the range of deposition angles, thereby centering the conical electron emitter within emitter well 130.

In the particular embodiment of FIG. 3, emitter well path 220 follows a line which is angularly displaced from a reference line 240 by a path angle 235. Path angle 235 is greater than 0° and less than 30°, preferably within a range of 5°–25°, more preferably within a range of 10°–20°, and most preferably equal to about 15°. When path angle 235 is 15°, the minimum length of emitter well path 220, which provides exposure of emitter well 130 to the range of deposition angles, is shortest. This provides the benefit of being able to cycle over the range of deposition a maximum number of times for a given length of emitter well path 220, which is preferred for optimal emitter geometry. In this particular embodiment, substrate 155 is moved within a plane defined by substrate 155, back and forth, in a cyclical fashion, along the direction of emitter well path 220. Because plurality of emitter wells 130 define fixed points on the rigid structure comprising substrate 155, all of emitter wells 130 follow paths having the same path angle 235 with respect to reference line 240.

The configuration of emitter well path 220 with respect to collimator 160 also reduces shadowing effects due to the side walls of collimator 160 during the step of moving substrate 155.

Figure 4:
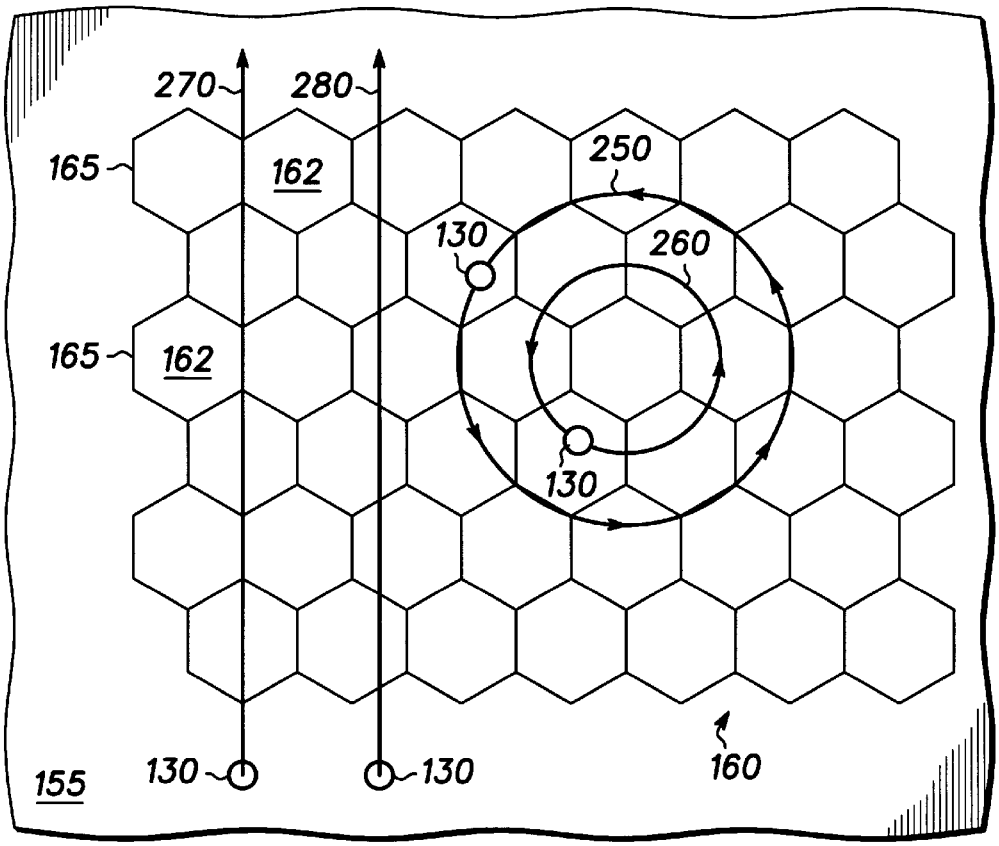
FIG. 4 is a top plan view of the collimator of FIGS. 2 and 3 and further indicates a path of an emitter well with respect to the collimator.

As indicated in FIG. 4, which is a top plan view of collimator 160 and substrate 155 (FIGS. 2 and 3), pure rotation of substrate 155 with respect to collimator 160 is inadequate and exhibits a shadowing effect that results in non-uniform amounts of material being deposited in emitter wells 130. A circle in FIG. 4 depicts a path 250 of one of emitter wells 130 relative to collimator 160, upon pure rotational relative displacement between collimator 160 and substrate 155 (FIG. 2). During a significant portion of path 250, the deposition material is blocked by the side walls which define collimation cells 162. Others of emitter wells 130, a representative one of which has a path 260 depicted by a circle in FIG. 4, receive a greater amount of deposition material due to a lesser degree of masking by the side walls which define collimation cells 162.

Similarly, a lateral relative displacement between substrate 155 and collimator 160, having a path angle equal to 30°, is inadequate, as indicated in FIG. 4. For this configuration, some of emitter wells 130 follow a path 270, as indicated in FIG. 4, wherein side walls 165 cause a shadowing effect similar to that of path 250. During the same lateral relative displacement, emitter wells 130 which follow a path 280, as indicated in FIG. 4, receive a greater amount of deposition material due to a lesser degree of masking by side walls 165.

The present method solves this problem by providing a lateral relative displacement between the substrate and the collimator which defines emitter well paths which provide substantially uniform shadowing by the side walls of the collimator, thereby depositing an equal amount of material in each of the emitter wells.

Static depositions, wherein there is no relative motion between the collimator and the substrate, are also undesirable due to the shadowing effect of the finite width of all of the side walls of the collimator. The present method solves this problem by providing relative displacement between the collimator and the substrate at a predetermined angle with respect to a reference line of the collimator cross-section, so that the amount of material deposited within each emitter well is uniform over the plurality of emitter wells.

Figure 5:
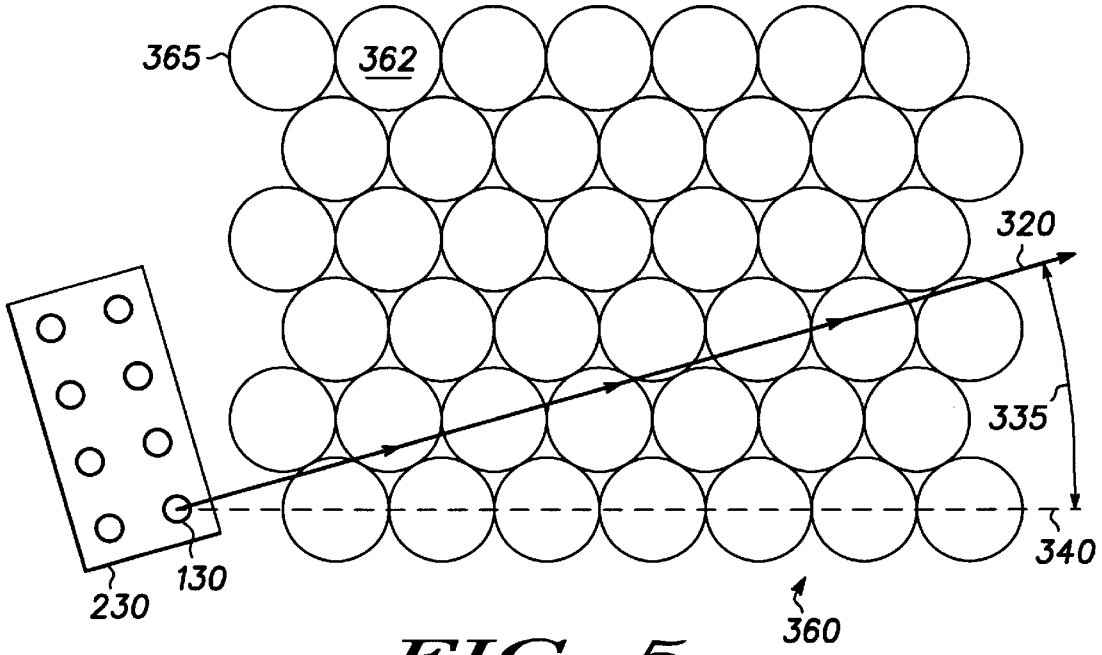
FIG. 5 is a top plan view, similar to that of FIG. 3, of another collimator suitable for performing various steps of a method for fabricating an array of conical electron emitters, in accordance with the present invention.

Referring now to FIG. 5, there is depicted a top plan view, similar to that of FIG. 3, of a collimator 360 suitable for performing various steps of a method for fabricating an array of conical electron emitters, in accordance with the present invention. Collimator 360 includes a plurality of side walls 365 defining a plurality of collimation cells 362 having circular cross-sections. The predetermined cross-sectional dimension, in this particular embodiment, includes the diameter of the circular cross-section. In accordance with the present invention, each of a plurality of emitter well paths 320 of emitter wells 130 includes a line which is angularly displaced from a reference line 340 by a path angle 335, which is greater than 0° and less than 30°, preferably within a range of 5°–25°, more preferably within a range of 10°–20°, and most preferably equal to about 15°. In this particular embodiment, substrate 155 is moved within a plane defined by substrate 155. Substrate 155 is moved in a cyclical fashion, back and forth, so that emitter wells 130 retrace emitter well paths 320 repeatedly. Because plurality of emitter wells 130 define fixed points on the rigid structure comprising substrate 155, all of emitter wells 130 follow paths having the same path angle with respect to reference line 340.

EXAMPLE

Figure 6:
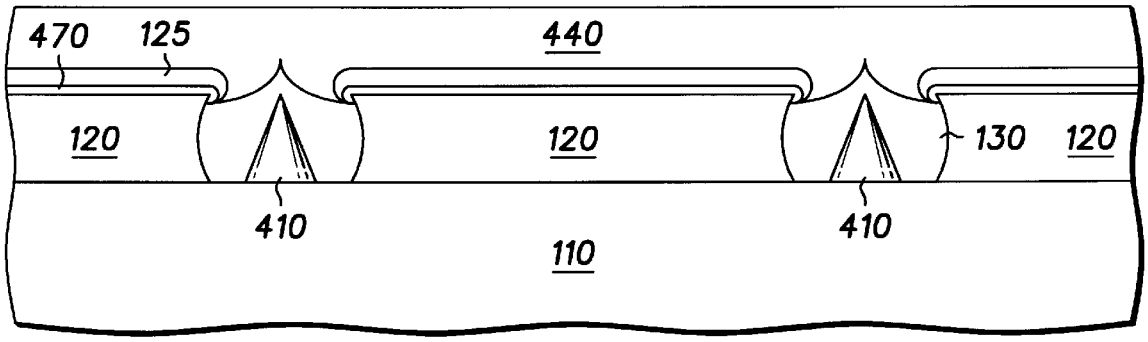
FIG. 6 is a view similar to that of FIG. 1 of a structure realized by performing various steps of a method for fabricating an array of conical electron emitters, in accordance with the present invention.

Referring now to FIG. 6, there is depicted a view, similar to that of FIG. 1, of a structure 400 realized by performing various steps of a method for fabricating an array of conical electron emitters 410 within an array of emitter wells 130, in accordance with the present invention. Each of emitter wells 130 had a diameter of about 1 micrometer, and the substrate had an overall area of 45 $cm^2$. A target made from molybdenum was sputtered in an MRC 603 sputterer made by Materials Research Corporation, located in Orangeburg, N.Y. The sputtering energy was 5000 watts in an ionized argon atmosphere having a pressure of 4 milliTorr. The ionized argon was directed toward the molybdenum target. In this particular example, a collimator having a thickness of 1.25 cm and a collimation cell diameter of 0.625 cm was employed. The overall area of the collimator was 130 $cm^2$, and the cross-sectional geometry was hexagonal (FIG. 3). This collimator was obtained from Eldim, located in Massachusetts. In this particular example, for a pressure of 4 milliTorr, the distance between the substrate and the collimator was about 0.625 cm, and the distance between the collimator and the molybdenum target was about 1.56 cm. The ratio of the thickness of the collimator to the diameter of the collimation cell was about 2:1, thereby providing an efficiency of about 8% and thereby providing sufficient collimation to control the rate of via cusping (closing off of the opening of the emitter well). The paths of the emitter wells formed a line having a path angle, with respect to a reference line of the hexagonal cross-section (FIG. 3), which was about 15°. The substrate was moved, within the plane of the substrate, back-and-forth for about 150 cycles at a speed of about 200 cm/minute.

Structure 400 was formed as described with reference to the above example. A via cusp 440 was formed from a portion of the partially collimated sputtered target material. The rate of formation of via cusp 440, relative to the rate of deposition of collimated material into emitter wells 130, was adequate for forming conical electron emitters 410 having sufficiently small tip radii. Conical electron emitters 410 had uniform sizes and shapes over the area of the substrate. Each conical electron emitter 410 was symmetrical with respect to the axis of the emitter well 130 in which it was formed. Additionally, the tips of conical electron emitters 410 were located within a plane defined by a gate extraction electrode 470, which was formed on dielectric layer 120. Via cusp 440 was removed by selectively etching parting layer 125, which was formed on gate extraction electrode 470 prior to the formation of conical electron emitters 410. Parting layer 125 was made from aluminum, in this particular example.

In general, the mean free path of the gaseous species within the sputtering tool decreases with increasing pressure. This determines the dimensions of the collimation cells of the collimator. At higher pressures, the cell cross-sectional dimension is made smaller, and the collimator is placed closer to the substrate.

In summary, a method has been disclosed for fabricating an array of conical electron emitters suitable for fabricating large area devices, such as those envisioned for field emission displays. The present method provides the important advantages of uniformity over the array of emitter size and symmetrical emitter geometry. Additionally, equipment having smaller dimensions may be used, which is an improvement over prior art evaporative systems and which provides the advantage of reduced maintenance and floor space requirements. Also, the present method allows the use of the same piece of equipment, without modifications, to process a range of substrate sizes, which is a distinct advantage over prior art evaporative systems.

While We have shown and described specific embodiments of the present invention, further modifications and improvements will occur to those skilled in the art. We desire it to be understood, therefore, that this invention is not limited to the particular forms shown and We intend in the appended claims to cover all modifications that do not depart from the spirit and scope of this invention.

We claim:

1. A method for fabricating an array of conical electron emitters comprising the steps of:

providing a substrate having a major surface having a plurality of emitter wells;

providing a collimator having first and second major surfaces having a predetermined thickness therebetween, the collimator having a plurality of side walls defining a plurality of collimation cells, each of the plurality of collimation cells having an entrance aperture in the first major surface and an exit aperture in the second major surface;

directing an uncollimated gaseous source of emitter material toward the first major surface of the collimator, a portion of the uncollimated gaseous source of emitter material exiting at the exit aperture of each of the plurality of collimation cells to be received at the major surface of the substrate over a range of deposition angles;

providing cyclical lateral relative displacement between the substrate and the collimator to define a plurality of emitter well paths, the configuration of the plurality of emitter well paths with respect to the collimator being predetermined so that each of the plurality of emitter well paths provides substantially uniform exposure of each of the plurality of emitter wells to substantially the full range of deposition angles and further provides substantially uniform shadowing of the plurality of emitter wells by the plurality of side walls of the collimator;

wherein the step of providing a collimator includes providing a collimator having a plurality of collimation cells each of which defines a cylinder having a hexagonal cross-section;

wherein the step of providing cyclical lateral relative displacement between the substrate and the collimator includes the step of providing cyclical lateral relative displacement between the substrate and the collimator to define a plurality of emitter well paths, each of the plurality of emitter well paths forming a path angle with a reference line of the collimator, the path angle being greater than 0 degrees and less than 30 degrees; and wherein the path angle is within a range of 5–25 degrees.

2. The method for fabricating an array of conical electron emitters as claimed in claim 1, wherein the path angle is within a range of 10–20 degrees.

3. The method for fabricating an array of conical electron emitters as claimed in claim 2, wherein the path angle is about 15 degrees.

4. A method for fabricating an array of conical electron emitters comprising the steps of:

providing a substrate having a major surface having a plurality of emitter wells;

providing a collimator having first and second major surfaces having a predetermined thickness therebetween, the collimator having a plurality of side walls defining a plurality of collimation cells, each of the plurality of collimation cells having an entrance aperture in the first major surface and an exit aperture in the second major surface;

providing a target made from an electron emissive material;

disposing the target a distance from the substrate to define a interspace region therebetween;

disposing the collimator in the interspace region so that the second major surface of the collimator opposes the major surface of the substrate and the first major surface of the collimator opposes the target;

sputtering the target to provide a sputtered target material so that the sputtered target material is received by the first major surface of the collimator, a portion of the sputtered target material exiting at the exit aperture of each of the plurality of collimation cells, the portion of the sputtered target material being received at the major surface of the substrate and defining a range of deposition angles; and providing cyclical lateral relative displacement between the substrate and the collimator to define a plurality of emitter well paths, the configuration of the plurality of emitter well paths with respect to the collimator being predetermined so that each of the plurality of emitter well paths provides substantially uniform exposure of each of the plurality of emitter wells to substantially the full range of deposition angles and further provides substantially uniform shadowing of the plurality of emitter wells by the plurality of side walls of the collimator;

wherein the step of providing a collimator includes providing a collimator having a plurality of collimation cells each of which defines a cylinder having a hexagonal cross-section;

wherein the step of providing cyclical lateral relative displacement between the substrate and the collimator includes the step of providing cyclical lateral relative displacement between the substrate and the collimator to define a plurality of emitter well paths, each of the plurality of emitter well paths forming a path angle with a reference line of the collimator, the path angle being greater than 0 degrees and less than 30 degrees; and wherein the path angle is within a range of 5–25 degrees.

5. The method for fabricating an array of conical electron emitters as claimed in claim 4, wherein the path angle is within a range of 10–20 degrees.

6. The method for fabricating an array of conical electron emitters as claimed in claim 5, wherein the path angle is about 15 degrees.

* * * * *